United States Patent [19]

Sundsrud et al.

[11] 4,209,130

[45] Jun. 24, 1980

[54] ADHESIVE TAPE FOR PROTECTING ELECTRICALLY INSULATED RAIL JOINT

[75] Inventors: Gerald J. Sundsrud, Blaine; Bruce A. Marteness, Inver Grove Heights, both of Minn.

[73] Assignee: Minnesota Mining and Manufacturing Company, St. Paul, Minn.

[21] Appl. No.: 851,510

[22] Filed: Nov. 14, 1977

[51] Int. Cl.[2] ..... E01B 11/54

[52] U.S. Cl. ..... 238/152; 174/138 D; 191/39; 238/153; 428/355

[58] Field of Search ..... 238/152, 153, 154, 155, 238/156; 191/39; 174/138 D; 428/355; 260/33.6 AQ

[56] References Cited

U.S. PATENT DOCUMENTS

| | | | |
|---|---|---|---|
| 3,593,919 | 3/1969 | Hamilton, Jr. | 238/152 |
| 3,684,644 | 8/1972 | Snell | 428/355 |
| 3,810,707 | 5/1974 | Tungseth et al. | 404/67 |
| 4,071,652 | 1/1978 | Brullo | 428/355 |

FOREIGN PATENT DOCUMENTS

| | | | |
|---|---|---|---|
| 730912 | 1/1943 | Fed. Rep. of Germany | 238/152 |
| 718009 | 11/1954 | United Kingdom | 238/152 |

*Primary Examiner*—John J. Love
*Assistant Examiner*—Ross Weaver

[57] ABSTRACT

An electrically insulated rail joint is protected from electrical shorting by laying an adhesive tape against the undersides and around the toes of the rails across their juncture. The adhesive tape has a thin plastic film backing which is exceedingly stretchy and a thick adhesive which is tacky, stretchy, self-sealing and more adhesive than cohesive.

12 Claims, 1 Drawing Figure

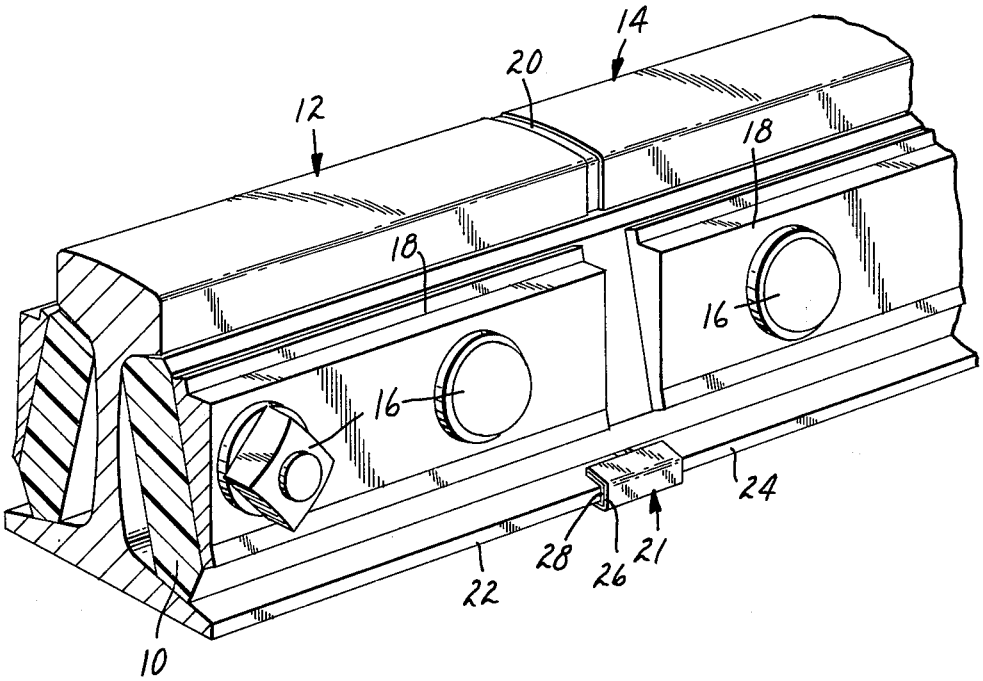
14
20
12
18
18
16
16
24
28
26
21
22
10

ADHESIVE TAPE FOR PROTECTING ELECTRICALLY INSULATED RAIL JOINT

BACKGROUND OF THE INVENTION

In an electrically insulated rail joint, magnetic flux lines tend to be concentrated across the space between the two rails, especially when the joint bars or fishplates include no metal, as in U.S. Pat. No. 3,369,752 (Youngward and Kovalchuk). The magnetic flux lines tend to attract iron and other ferromagnetic particles which may bridge the space between the rails to cause an electrical short. Usually it is then necessary to dismantle the joint in order to remove the ferromagnetic particles.

The particles primarily collect along the juncture of the rails at the undersides and at the uppersides of the rail bases. To the extent that the particles collect between the joint bars and the rails, electrical shorting can be effectively inhibited by employing an insulating end post which extends outwardly beyond the rail surfaces. The same beneficial effect has been achieved by extending the insulating end post downwardly below the undersides of the rails and outwardly beyond their toes, but this requires that there be no tie plate immediately beneath the end post. To achieve this, it would often be necessary to reposition the ties.

Other Prior Art

The present invention makes use of an adhesive tape, the adhesive of which may be the same as that employed in U.S. Pat. Nos. 3,810,707 (Tungseth and Lindlof) and 4,001,167 of which 3,810,707 is a continuation-in-part. The adhesive is tacky and self-sealing but is not a pressure-sensitive adhesive in that it is more adhesive than cohesive. In the latter respect it differs from those adhesives in U.S. Pat. No. 3,239,478 (Harlan) which are pressure-sensitive adhesives even though based on the same ingredients.

THE INVENTION

The problem of protecting an electrically insulated rail joint from electrical shorting across the space between the bases of the abutting rails is minimized by laying against the undersides and around the toes of the rails across their juncture an adhesive tape comprising (a) a thin pigmented electrical-insulating plastic film backing which is weak, supple and highly stretchable but is resistant to deterioration under adverse environmental conditions and (b) an electrical-insulating adhesive layer which is aggressively tacky, highly stretchable, self-sealing, more adhesive than cohesive and has a thickness within the approximate range of 0.25 to 1.25 mm. While the adhesive may be the same as those of patents discussed above under "Other Prior Art," the backing member is substantially weaker than any backing member employed in the examples of those patents. The backing member is called "weak" to indicate that a very small force is sufficient to stretch it appreciably.

Specifically, the backing when tested at ordinary room temperature (22° C.) should have an elongation of at least 300% and should stretch at least 300% under a force of 200 to 1800 grams per cm of width, preferably 700 to 1200 grams per cm of width. When a stronger backing has been tried, it has tended to pull the adhesive away from the rails during periods of rail contraction, especially at cold temperatures. On the other hand, it might be difficult to handle the adhesive tape if its backing would stretch 300% under a force of less than 200 grams per cm of width.

Particularly preferred as the backing is low density polyethylene film having a thickness of about 100 micrometers which is highly pigmented for protection to ultraviolet light since the film backing should be resistant to ordinary environmental conditions. Preferably the pigment presents a light color, since a dark backing might absorb so much radiation from the sun as to produce undesirably high localized heating. That preferred film has an elongation at break of about 800% and stretches at least 300% under a force of about 900 grams per cm of width. The same film at a thickness of 200 micrometers stretches at least 300% under a force of about 1800 grams per cm of width. While a pigmented polyethylene film as thin as about 20 micrometers should be useful, thinner film is considered to be too flimsy to be practical for commercial usage.

Due to the supple, stretchy nature of the backing, it is considered to be impractical in the present state of the art to coat the adhesive composition directly onto the backing. Rather, the adhesive layer should be applied by transfer techniques which are well known in the art.

Like adhesive compositions of U.S. Pat. Nos. 3,810,707 and 4,001,167, that of the adhesive layer of the tape of the present invention is preferably based on highly aromatic, high-boiling, viscous process oils modified by the incorporation of restricted amounts of certain block copolymers of non-elastic vinyl arene and elastic conjugated diene polymers together with small amounts of other modifiers as desired. The amount of the copolymer may be about 25 to 100 parts per 100 parts by weight of the process oil, but preferably does not exceed 50 parts because the process oil is much less expensive than the copolymer.

Preferred block copolymers have the type formula A-B-A, wherein each A is a non-elastomeric polymer block of a vinyl arene and has an average molecular weight of about 5000 to about 125,000 or even higher, and B is a polymer block of a conjugated diene and has an average molecular weight of about 75,000 to about 250,000. The total A component may be between about 10 and about 40 percent, with preferred examples being between about 15 and about 30 percent of polystyrene A blocks and the balance being polyisoprene or polybutadiene B blocks.

Preferred process oils are high-boiling viscous materials having an initial boiling point of at least about 370° C. and an SSU viscosity at 99° C. of at least about 250. Analysis by the clay-gel method indicates an aromatic content of at least 50% and usually above 55%.

The tendency of the aromatic process oils to crystallize at low temperatures and to cause embrittlement or loss of shock resistance in the adhesive mass may be reduced by selection of the lower viscosity process oils or by addition of small amounts of non-crystallizing paraffinic oils or polymers. The amount of such additives must be small in order to avoid excessive softening and flow of the adhesive at high use temperatures, a tendency which results also when using the lower molecular weight or low styrene content block polymers.

The addition of small amounts of compatible low molecular weight polyolefin polymers, e.g., polyethylene, serves also as a means of overcoming softening and plastic flow in these compositions, but has a tendency to reduce the adhesion and elongation values. The proportion of such polyolefin additive is therefore to be restricted to not greater than 30 parts, or preferably 25 parts, per 100 parts of the copolymer.

The aromatic process oils ordinarily provide adequate tackiness and good adhesion to the rails. When additional tackiness is required, it may be achieved by the incorporation of small amounts of compatible tackifier resins such as polyterpene resin or other non-crystallizing resinous tackifiers, a number of which are listed in U.S. Pat. No. 3,239,478.

The adhesive tape of the invention adheres well to steel which has been given only a cursory wiping and may still be contaminated by dirt, moisture or frost, oil or other foreign matter. Adhesive layers of at least 0.5 mm in thickness are especially useful in this respect. If the adhesive layer were thinner than about 0.25 mm, it would be desirable to clean the rail surfaces before applying the tape. On the other hand, adhesive thicknesses exceeding 0.8 mm are considered to be unnecessary and hence wasteful.

Adhesion Value

To measure the adhesion value of the adhesive composition, a 640-micrometer-thick coating of the adhesive is applied to biaxially oriented polyethylene terephthalate film backing 50 micrometers in thickness. The resultant tape is laid against a clean stainless steel plate and a 2.25-kg hard rubber roller is passed twice along its length at a speed of 30 cm/min. Using an Instron Tensile Tester at a crosshead speed of 30 cm/min., the tape is peeled away at 90° to the steel plate.

The adhesive composition should have an adhesion value of at least 1000 grams per cm of width. At lower values, the tape might begin to peel back from the rails under severe contraction of the rails. However, by using a backing member which will elongate 300% under a force approaching 200 grams per cm of width, an adhesion value approaching 500 grams per cm of width should be useful.

Elongation

The elongation of the adhesive composition is tested as disclosed at column 7, line 63 et seq. of U.S. Pat. No. 3,810,707. The elongation should be at least 500% at the test temperature (22° C.) and preferably should exceed 1500%, because adhesive compositions having high elongation tend to adhere better to contaminated rail surfaces.

The Drawing

The single FIGURE is a fragmentary schematic perspective of an electrically insulated rail joint of the type disclosed in the aforementioned U.S. Pat. No. 3,369,752.

A pair of electrically insulated joint bars 10 are clamped across the juncture between two rails 12, 14 by a number of bolts 16 acting against two spaced pairs of bearing plates 18. Between the ends of the rails is an insulated end post 20 which typically is about 1 cm in thickness. An adhesive tape 21 is wrapped around the toes 22, 24 of the rails 12, 14 at their juncture, across the undersides of the rails and around their toes at the other side. The adhesive tape 21, which may have a width of 10 cm, has a weak, stretchable electrical-insulating plastic film backing 26 and a tacky, self-sealing adhesive layer 28 which adheres it to the rails.

In a typical installation, both rails may expand to contact the end post (as shown) during the heat of the day and contract at night to provide a total spacing between the rails and end post of 2 or 3 cm. It is remarkable that in spite of this, the adhesive tape remains adhered by its adhesive layer to the rails and effectively prevents ferromagnetic particles from bridging the gap between the rails. Even if the adhesive layer should rupture if the rails were to contract to an unusually large spacing, the adhesive layer would heal itself during the subsequent rail expansion by virtue of its self-sealing nature.

EXAMPLE

In this example, all parts are by weight.

A preferred adhesive composition was prepared by first heating to 270° C. 54.2 parts of aromatic hydrocarbon process oil boiling above 370° C. and having an SSU viscosity at 99° C. of 478 and analyzing 57.6% aromatics by the clay-gel method ("Dutrex No. 957" process oil). Under inert atmosphere and with continued agitation was added 5.7 parts butyl zimate powder as antioxidant and accelerator, immediately followed by 12.6 parts of an A-B-A type styrene-isoprene block copolymer containing 14% polystyrene ("Kraton 1107") and 8.5 parts of A-B-A type styrene-butadiene block copolymer containing 28% styrene ("Kraton 1101"). Solution of the copolymers was accomplished with continued agitation in about three hours. There was then added 7.6 parts of polyterpene resin tackifier ("Piccolite A-135"), 5.7 parts of white mineral oil (#31 USP) and 5.7 parts of powdered polyethylene resin having a melt index of 70 ("Microthene 714").

The well-mixed electrical-insulating adhesive composition was spread onto a silicone-treated paper using a knife coater and at a temperature of about 120° C. which is sufficient to maintain a spreadable consistency. After cooling, the coating had a thickness of approximately 0.64 mm.

The adhesion value of this adhesive composition was 2500 grams per cm of width, and its elongation exceeded 1500%.

Low density polyethylene film having a thickness of 100 micrometers was pressed against the exposed surface of the electrical-insulating adhesive layer to provide a thin electrical-insulating plastic film backing. This was cut into pieces 10 cm wide and 23 cm long which upon removal of the silicone-treated paper were useful for application of electrically insulated rail joints. When tested after removal of the silicone-treated paper, the tape of the example exhibited the following values (ASTM Test Method D-412):

Tensile strength at 21° C.—3320 kPa

Tensile strength at −18° C.—5350 kPa.

In each case the elongation exceeded 700%.

We claim:

1. Method of protecting an electrically insulated rail joint from electrical shorting by laying against the undersides and around the toes of the rails across their juncture an adhesive tape comprising (a) a pigmented electrical-insulating plastic film backing which is resistant to deterioration under adverse environmental conditions, has an elongation of at least 300% and will stretch at least 300% under a force of 200 to 1800 grams per cm of width, and (b) an electrical-insulating adhesive layer which is tacky, self-sealing and has when tested as herein described an adhesion value of at least 500 grams per cm of width and an elongation of at least 500%, is more adhesive than cohesive and has a thickness within the approximate range of 0.25 to 1.25 mm.

2. An electrically insulated rail joint which is protected from electrical shorting by an adhesive tape which is adhered by its adhesive layer to the undersides and around the toes of the rails across their juncture, which adhesive tape comprises (a) a pigmented electrical-insulating plastic film backing which is resistant to deterioration under adverse environmental conditions, has an elongation of at least 300% and will stretch at least 300% under a force of 200 to 1800 grams per cm of width, and (b) an electrical-insulating adhesive layer which is tacky, self-sealing and has when tested as herein described an adhesion value of at least 500 grams per cm of width and an elongation of at least 500%, is more adhesive than cohesive and has a thickness within the approximate range of 0.25 to 1.25 mm.

3. Adhesive tape for protecting an electrically insulated rail joint from electrical shorting across the space between the bases of the abutting rails comprising:

(a) a pigmented electrical-insulating plastic film backing which is resistant to deterioration under adverse environmental conditions, has an elongation of at least 300% and will stretch at least 300% under a force of 200 to 1800 grams per cm of width, and (b) an electrical-insulating adhesive layer which is tacky, self-sealing and has when tested as herein described an adhesion value of at least 500 grams per cm of width and an elongation of at least 500%, is more adhesive than cohesive and has a thickness within the approximate range of 0.25 to 1.25 mm.

4. Adhesive tape as defined in claim 3 wherein the pigmented plastic backing is low density polyethylene having a thickness of 20 to 200 micrometers.

5. Adhesive tape as defined in claim 3 wherein the pigmented plastic backing will stretch at least 300% under a force of 700 to 1200 grams per cm of width.

6. Adhesive tape as defined in claim 3 wherein said adhesive layer comprises a major proportion of an aromatic hydrocarbon process oil having a viscosity of at least about 250 (SSU/99° C.), an initial boiling point of at least about 370° C. and an aromatic content (clay-gel method) of at least about 50%; and a minor proportion of a block copolymer having the type formula A-B-A wherein the A components account for about 10–40 percent of the total, each A is a non-elastomeric vinyl arene polymer block having an average molecular weight of about 5000 to about 125,000 and B is an elastomeric conjugated diene polymer block having an average molecular weight of about 75,000 to about 250,000; the amount of said copolymer being between about 25 and about 50 parts per 100 parts of said oil.

7. Adhesive tape as defined in claim 6 wherein said adhesive layer includes a polyolefin polymer in an amount up to about 30 parts per 100 parts of said copolymer.

8. Adhesive tape as defined in claim 6 wherein said adhesive composition includes a small amount of tackifier resin.

9. Adhesive tape as defined in claim 6 wherein said adhesive composition includes a small amount of paraffinic oil.

10. Method of protecting an electrically insulated rail joint as defined in claim 1 wherein there is an electrically insulating end post about one cm in thickness between the rails and the width of the adhesive tape is about 10 cm.

11. An electrically insulated rail joint as defined in claim 2 having an electrically insulating end post about one cm in thickness between the rails and the width of the adhesive tape is about 10 cm.

12. Adhesive tape as defined in claim 3 and having a width of about 10 cm.

* * * * *